United States Patent [19]

Sweazey et al.

[11] Patent Number: 4,491,269

[45] Date of Patent: Jan. 1, 1985

[54] PARKING LOT FEE BOX

[76] Inventors: Donald G. Sweazey, 14012 Corliss N., Seattle, Wash. 98133; Glenn B. Gallaugher, Jr., 1202 NW. 199th Pl., Seattle, Wash. 98177

[21] Appl. No.: 488,736

[22] Filed: Apr. 26, 1983

[51] Int. Cl.[3] ..... B65D 91/00

[52] U.S. Cl. ..... 232/43.2; 232/1 D

[58] Field of Search ..... 232/1 D, 1 R, 7, 9, 232/12, 43.1, 43.2; 194/1 F, 1 G

[56] References Cited

U.S. PATENT DOCUMENTS

| | | | |
|---|---|---|---|
| 527,589 | 10/1894 | Bristol | 232/43.2 X |
| 1,121,089 | 12/1914 | Grenfell | 232/43.2 X |
| 2,272,904 | 2/1942 | Burton et al. | 194/1 G X |
| 3,306,486 | 2/1967 | Martino et al. | 220/1 T |
| 4,356,956 | 11/1982 | Long | 232/1 R X |

*Primary Examiner*—Robert P. Swiatek

*Attorney, Agent, or Firm*—Delbert J. Barnard

[57] ABSTRACT

A parking lot fee collection box includes a top wall carrying a plurality of slots through which money is inserted, each slot being numbered and being associated with a parking space of the same number. Money placed into the slot falls vertically downwardly into a collection compartment which is one cell of a receptacle contained within a storage space below the money slot carrying top wall. Each compartment is vertically deep and its bottom is spaced a considerable distance from the money slot. A vertical space is provided between the upper ends of the compartments and the money slot carrying top wall. A hood structure covers the money slot carrying top wall. The hood both blocks the passage of light into the slots and limits the vertical space above the slots. A door forms a front closure for the box and normally closes access opening into the chamber in which the money collecting receptacles are stored. The door has inwardly turned lips at its edges which fit into slots formed by and between sidewalls and brace members connected to the sidewalls.

11 Claims, 6 Drawing Figures

ENVELOPE

PARKING LOT FEE BOX

DESCRIPTION

1. Technical Field

This invention relates to parking lot fee collection boxes, and in particular to an improved collection box constructed to prevent nonpayment and theft problems experienced with known collection boxes.

2. Background Art

A commonly used parking lot fee collection box comprises a vertical front panel containing a plurality of numbered slots, corresponding to a like number of numbered parking spaces. Each slot provides an entrance into a money compartment located inside of the box. In use, a customer parks and locks his vehicle and then inserts the parking fee into the collection box slot bearing the same number as the parking space occupied by his vehicle.

There are two problems associated with this known type of fee collection box, both resulting in a loss of revenue to the parking lot owner. One is theft. It has been found that a wire hook can be inserted through a slot and used for removing folded paper currency, or at least bringing it to the slot whereat it can be grasped and removed by a pair of tweezers. Secondly, it has been found that some customers will look into a slot to see if the money paid by the last person is still in the collection box, and if so, will intentionally not insert payment.

An additional problem associated with the known fee collection boxes is that the paper currency must be folded into small squares in order to make it fit into the relatively small money compartments. This makes it easier for a thief to catch ahold of the folded paper currency by use of a hooked wire or the like. It also increases the counting cost as the counter has to unfold each piece of paper currency as a part of the counting procedure.

The main object of the present invention is to provide an improved parking lot fee collection box which eliminates the theft, nonpayment and counting problems which are described above.

DISCLOSURE OF THE INVENTION

In basic form, a parking lot fee collection box constructed in accordance with the present invention comprises money slots in a top wall, each of which is vertically aligned with an associated individual money receiving compartment.

Preferably, the upper ends of the compartments are spaced below the money slot carrying top wall at least about three-fourths of an inch, and preferably between seven-eighths of an inch to one inch, to provide a top space between each money slot and the top of the money receiving compartment associated with the slot. The provision of this top space alone helps prevent theft because it prevents a would-be thief from using a wire to draw a bill up a sidewall of its storage compartment, all the way up to the slot. The sideways force exerted by the wire to hold the bill against the compartment sidewall is released when the wire end and bill move out from the compartment, causing a sideways movement of the bill through the top space and away from the slot.

Another aspect of the invention is that each money receiving compartment is vertically elongated. Preferably, each money receiving compartment is at least four times longer in the vertical direction than it is wide or deep in the horizontal direction. This provides several advantages. Firstly, each compartment can hold a larger number of bills. Secondly, they will all be spaced a relatively large distance away from the slot. Also, each bill will only have to be folded once, along a longitudinal center line, resulting in a considerably saving of time in handling the money during counting.

In accordance with another aspect of the invention, the fee collection box is provided with a hood structure which overhangs the money slot carrying top wall. The hood structure provides a rain cover, but more importantly, it helps prevent theft and nonpayment problems. It reduces the vertical space above the slots, essentially preventing a person from sticking his head into a position to look through a slot down into the compartment below. It further blocks off sunlight, so that any line of sight through a slot that can be had will be into a dark space. It also prevents a would-be thief from inserting a wire straight down into a slot. A wire would have to be bent, both going into and coming out from a slot, making it more difficult to manipulate the wire in such a manner as to grab onto a bill.

In accordance with another aspect of the invention, the money receiving receptacles are constructed from a see-through material, so that a parking lot attendant can merely open a door at the front of the collection box and look through the receptacles to see which compartments contain money and which do not. The receptacles are easily removable for emptying into a collection receptacle.

In accordance with a further aspect of the invention, a means is provided to make it difficult for a person to insert a pry bar between an edge of the door and a sidewall of the box and pry the door open. The door is constructed to include inwardly projecting lips. Brace members are secured to inner sidewall portions of the box. The brace members and the sidewalls of the box define slots into which the door lips extend. Any attempt to bend the door by use of a pry bar will merely rotate the lip against the side boundaries of the slot.

Other more detailed features of the invention are described in the description of the preferred embodiment and are particularly pointed out in the appended claims.

BRIEF DESCRIPTION OF THE DRAWINGS

In the drawings, which show a preferred embodiment of the invention, like element designations refer to like parts throughout the several views.

DESCRIPTION OF THE PREFERRED EMBODIMENT

Figure 1:
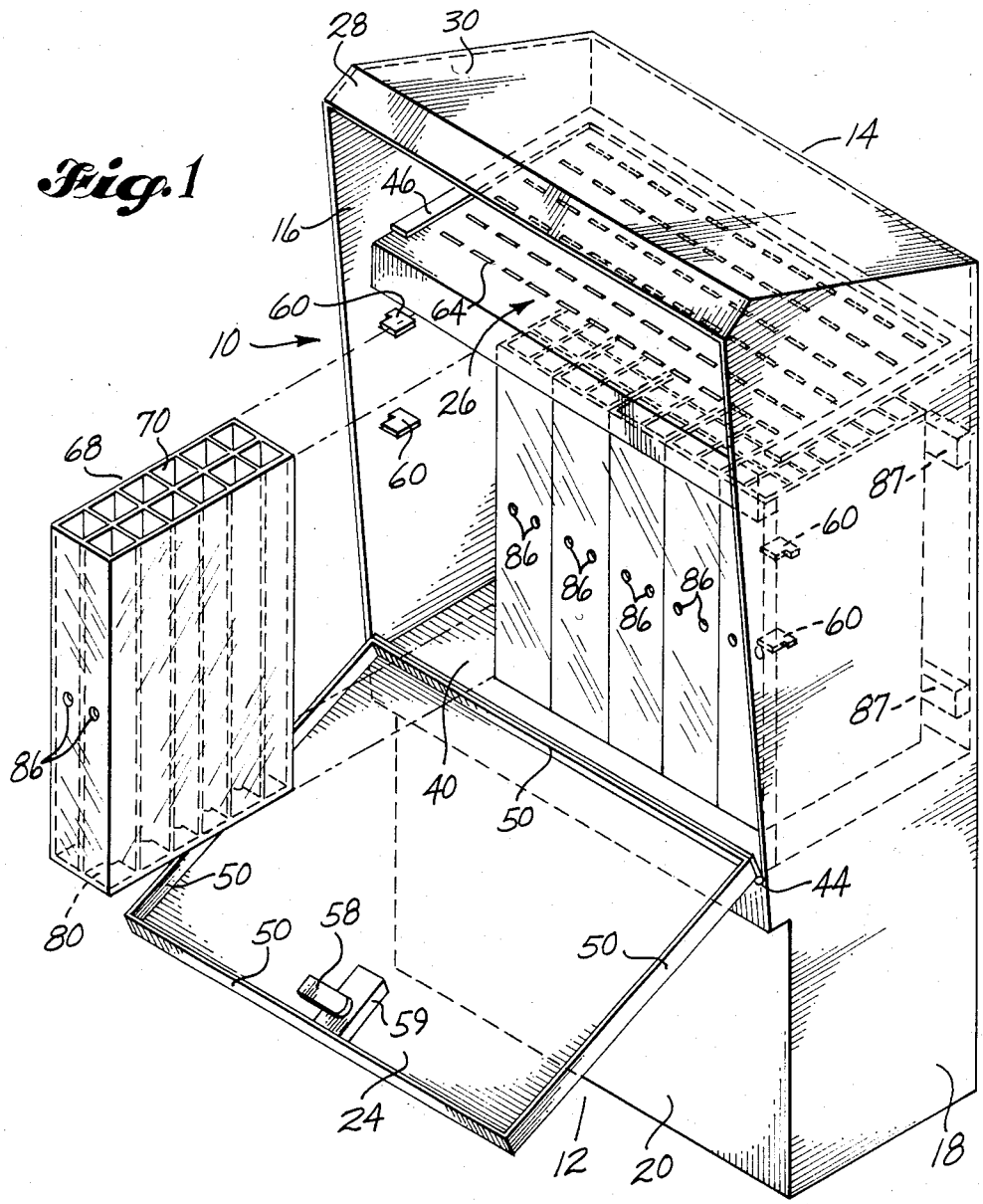
FIG. 1 is a pictorial view of a parking lot fee collection box constructed according to the present invention, looking from above toward the front and one side of the box, and showing a front door swung down into an open position, and further showing one of a plurality of money receiving receptacles exploded out from its position within the storage chamber and a plurality of additional receptacles in place within the chamber.
Figure 2:
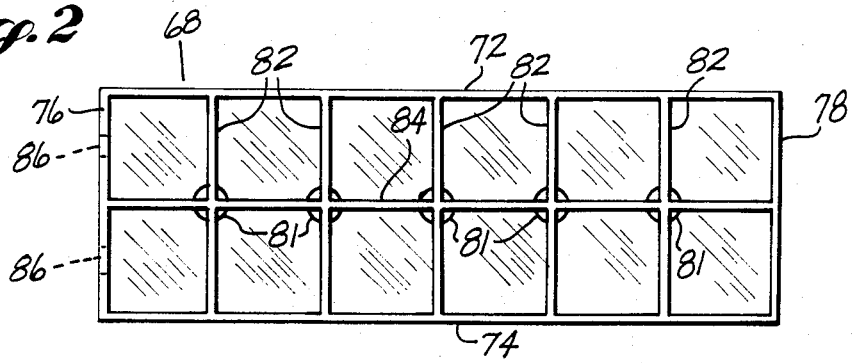
FIG. 2 is a top plan view of one of the money receiving receptacles.

The parking lot fee collection box 10 comprises an all steel body having a base portion 12 and an upper portion 14.

The box body is composed of one piece sheet metal sidewalls 16, 18, a lower sheet metal front wall 20, a sheet metal rear wall 22, a sheet metal front door 24, a sheet metal top wall 26 and a sheet metal hood 28, 30.

Figures 3, 4, 5:
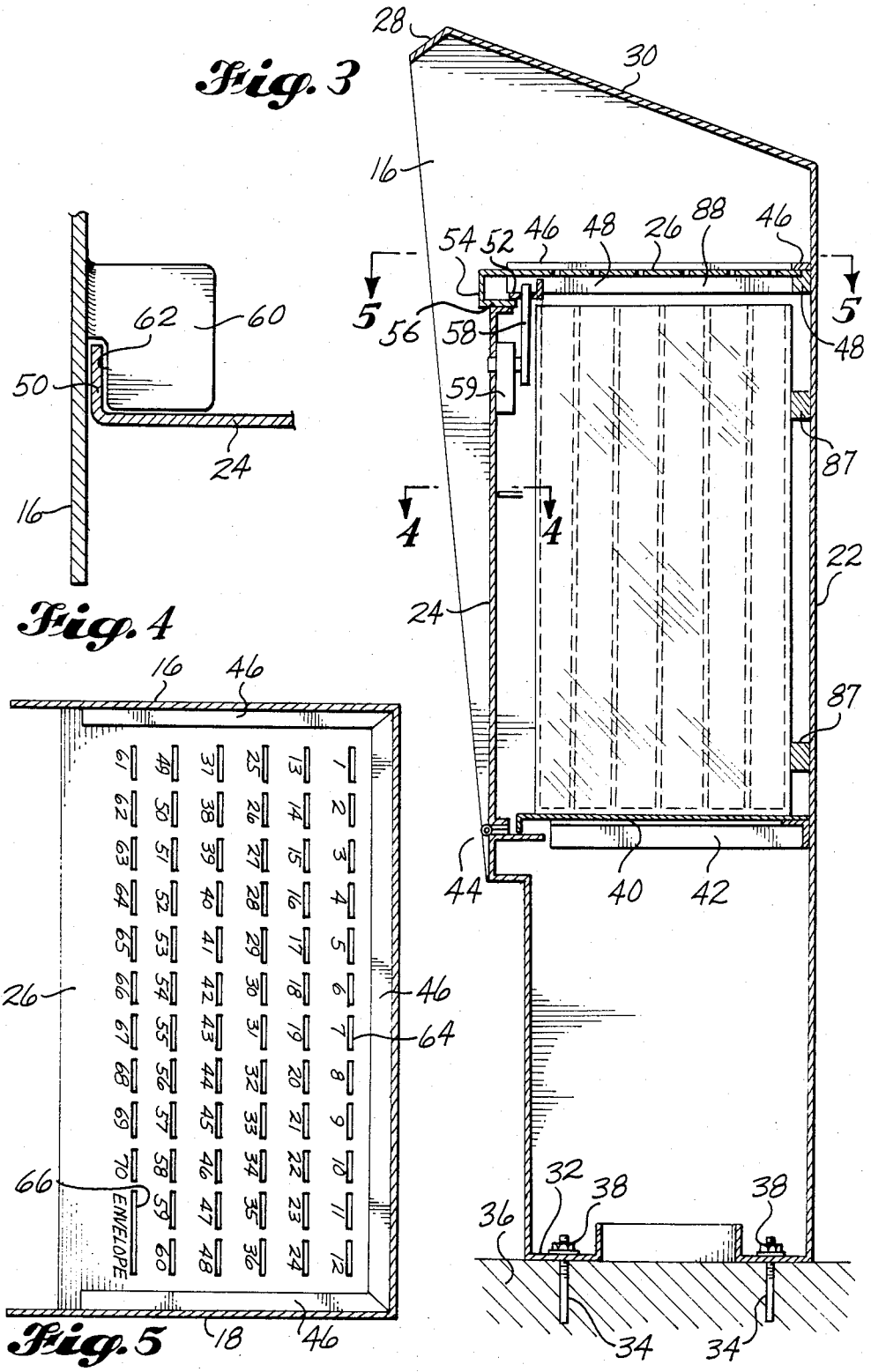
FIG. 3 is a vertical sectional view of the fee collection box, showing the manner in which the hood structure extends over the money slots, and further showing the vertical space which is provided between the money slot carrying top wall and the upper ends of the money receiving compartments.
FIG. 4 is a sectional view taken substantially along line 4—4 of FIG. 3, and showing the relationship between a side lip portion of the door and one of a plurality of brace members which are provided to reinforce the door lip and make it more difficult to pry the door open.
FIG. 5 is a cross-sectional view taken substantially along line 5—5 of FIG. 3, and presenting a top plan view of the top wall of the compartment.

As best shown in FIG. 3, the base 12 may include a sheet metal bottom 32. Box 10 may be secured in place by means of anchor bolts 34 which are implaced in a concrete pad 36 and project upwardly through openings in bottom 32. Conventional nut type fasteners 38 are secured to the upper ends of the anchor bolts 34 to hold the box in place.

A money collection and storage chamber is defined vertically between the top wall 26 and a support shelf 40. Shelf 40 rests on angle iron members 42 which are secured to the side and rear walls 16, 18, 22, generally at the level of the front door hinge 44. Shelf 40 is removable to provide access into the interior of the base 12, for installing and removing the mounting nuts 38.

Top wall 26 is a flat panel member having square cut corners. The end portions of member 26 are received in slideways formed between a top member 46 and a bottom member 48. These members 46, 48 extend along the rear of the box to form a slot in which the rear edge portion of member 26 is received. Member 46 is installed by aligning its end portions with the slideways and in pushing it in until its rear end portion is within the rear slot. Then, it is firmly secured in place (by lock pins not shown) so that it cannot be removed by an unauthorized person. This manner of mounting the top 26 makes it impossible to remove the top for servicing or replacement.

The door 24 is hinged to a front portion of the cabinet by means of the aforementioned hinge 44. Door 24 may be constructed from a sheet of sheet metal which is bent at all four edges to form a lip 50 which extends perpendicular to the general plane of door 24. A length of channel iron 52, having an upwardly projecting vertical leg and a forwardly projecting horizontal leg, is interconnected between the sidewalls 16, 18, slightly above the upper edge of the door. Top wall 26 is formed to include a vertical front wall 54 and a rearwardly extending lip 56. Lip 56 extends horizontally rearwardly from wall 54 into a position contiguous and below the horizontal leg of member 52.

As shown in FIG. 3, the horizontal leg member 52 includes a slot for receiving a lock member 58 carried by door 34. Member 58 is a portion of a key operated lock assembly 59 which is mounted at an upper central location of door 24. A key is inserted into a forwardly directed key opening and used for rotating member 58 between an unlocked position (FIG. 1) and a locked position (FIG. 3).

Preferably, the sidewalls 16, 18 are provided with a plurality of brace members 60. Members 60 are welded or otherwise firmly secured to the sidewalls 16, 18. They project endwardly from the sidewalls 16, 18 and define slots 62 into which the side lips 50 of the door 24 extend. The members 60 make it difficult for someone to insert a pry bar between a side edge of door 24 and the adjacent sidewall 16 or 18 and use it to pry the door open, by bracing the door 24 against bending.

The top wall 26 is formed to include a plurality of money slots 64, 66. Each slot 64 is numbered with the same number of an associated parking space.

Figure 6:
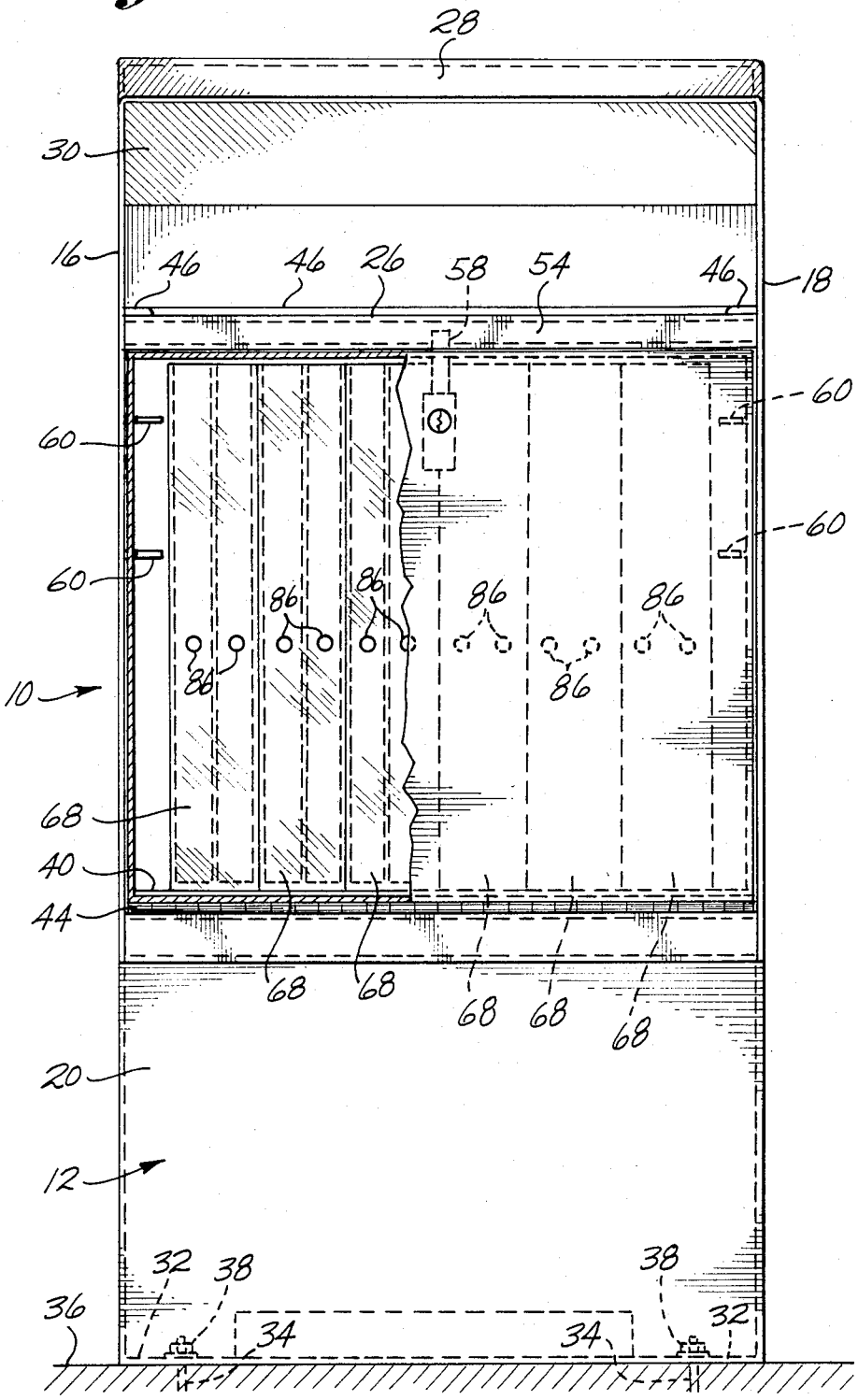
FIG. 6 is a front elevational view of the fee collection box, with a side portion of the door cut away to present front elevational views of some of the money collection receptacles.

As best shown by FIGS. 1, 3 and 6, money placed in the slots 64, 66 is collected by receptacles 68 which are divided into compartments 70. Each compartment 70 is positioned below one of the slots 64, 66.

Slot 66 is wider than the slots 64. It is provided for receiving envelopes containing payment by late payers. When a parking lot attendant finds a customer who has not paid, he places a pay notice on the customer's windshield, in the form of an envelope into which payment is to be inserted. Then, the customer is instructed to insert the envelope into the slot 66. Of course, one of the compartments 70 is made large enough to receive the envelopes.

Receptacles 68 are preferably constructed from a transparent or see-through plastic. Each comprises a pair of sidewalls 72, 74, a pair of end walls 76, 78 and a bottom wall 80. Internal walls 82, 84 divide the interiors of the receptacles 68 into the individual compartments 70.

The end walls 76 are formed to include a pair of openings 86 into which a fee collector can insert his thumb and forefinger when it is necessary to grap ahold of a receptacle 68, for insertion into or removal from the storage chamber.

The receptacles 68 are constructed from a see-through material so that the parking lot attendant can look into them from the front and determine whether or not all of the customers whose vehicles are in the parking lot at that time have paid.

Rubber bumpers 87 may be provided on the inside of the back wall 22, to provide for proper spacing of the receptacles 68 in the front to rear direction. The bottom walls 80 of the receptacles 68 are preferably formed to include drainage openings 81. These openings will permit any liquid which might be introduced through the slots into the compartments 70 to flow out through the lower ends of the compartments 70. Rain might blow into the hood opening or some prankster might throw some liquid into the opening.

Any bill snared by a wire would most likely be drawn up a sidewall of the compartment 70. This would require a sideways force on the wire, pushing the bill into contact with the compartment sidewall. Then, when space 88 is reached, this sideways force would no longer be countered by a compartment sidewall, most likely resulting in the wire springing sideways and the bill being thrust sideways out of reach from the slot.

The individual compartments 70 are intentionally made to be quite deep vertically. The customer is instructed to merely fold paper currency once, into a strip wide enough to fit into a slot 64. Thus, the paper currency does not have to be folded into a small square. Rather, it is received in an easy to open form. The person counting the money can easily and quickly unfold each bill as it is picked up, greatly reducing the cost of counting the money.

Referring to FIG. 3, in accordance with an important aspect of the invention, a vertical space 88 is provided between each slot 64 and the upper end of its compartment 70. This is done to make it more difficult for a would-be thief to fish money out of a compartment 70 by inserting a wire down through a slot 64 into the compartment 70. If a would-be thief were able to reach down and hook a bill, he would have to pull it through the space 88 in order to remove it from the slot 64. When the bill is within the space 88, it is more likely that movement of the wire will push the bill sideways and out of reach of the wire rather than in alignment withe the slot. Money collection is quite easy and fast. The money collector merely opens the door and removes the receptacles out from the storage chamber and empties their contents into a collection receptacle. As previously mentioned, the fact that the bills are folded only once facilitates their handling during the counting procedure. The person doing the counting can almost simultaneously, with picking a bill up, straighten, stack and count it. Under the old system, the bill is received in the form of a small square and must be unfolded by several movements of the bill and then straigntened out before it can be stacked. The time saved in counting paper currency made possible by the present invention is substantial in terms of dollars saved, considering that the counting procedure involves the handling of a large number of bills from a large number of parking lots, on a day-by-day basis. Also, the fact that the bills are folded once along a longitudinal center line will increase the difficulty of snaring a bill.

The presence of the hood 28, 30 provides an additional safeguard against theft. Hood 28, 30 provides a rain cover for the slotted top 26 and in addition provides additional antitheft protection in two ways. Firstly, it blocks light, making it difficult for a would-be thief to look down into the slots for the purpose of determining which compartments contain money. Secondly, hood walls 28, 30 are spaced a relatively close distance above top wall 26, preventing a person from inserting his head into the vertical space between walls 26 and 30. To the extent that it is possible for a person to insert his head into such space, his head will further block light. The hood 28, 30 further prevents insertion of a straight wire into a compartment 70 and prohibits vertical manipulation of the wire to fish out a bill. This hood feature, together with the considerable depth of the money receiving compartments 70, also makes it difficult for a new customer to determine if there is still money in the compartment received from a prior customer.

The hood structure projects horizontally forwardly of the front row of money slots. Wall 30 slopes downwardly from the front of the box toward the rear of the box. A window opening is defined vertically between the upper surface of wall 26 and the front lip of hood wall 28, and horizontally between the two sidewalls 16, 18. By way of typical example, the vertical height of this window may be about nine inches. The depth of the hood space at the rear of the hood space may be about five inches.

In a typical example, the receptacle 68 may measure about twenty-two inches high, four inches wide and twelve inches long. The compartments 70 are approximately two inches by two inches by twenty-two inches. In any given embodiment, the vertical length of the compartments should be at least four times the horizontal width and depth measurements of the compartment.

The vertical space 88 between the money slot carrying top wall 26 and the upper ends of the compartments 78 should be no less than about three-quarters of an inch high.

A second embodiment might be constructed like the disclosed embodiment but without a base. That is, the bottom of the box is formed by a fixed shelf and the box is adapted to be secured to a post.

The construction herein described and illustrated is a preferred embodiment of the invention. As many changes could be made in this construction without departing from the invention as defined by the appended claims, it is intended that the description and drawings shall be interpreted as illustrative and not in a limiting sense, and that the scope of the invention is to be limited only by such claims.

What is claimed is:

1. A parking lot fee collection box, comprising:

wall means defining a money receiving and storage chamber, said wall means including a door openable to provide access into said chamber, and a top wall including a plurality of money slots; and money receiving receptacle means in said top wall, including a plurality of individual compartments, one for each slot, each said compartment being vertically aligned with its slot;

said box comprising a lower base portion and an upper portion and said base portion is adapted to be bolted to a mounting pad;

wherein said base portion includes internal bottom wall means including openings for receiving anchor bolts which project through said openings; and a removable shelf defining the bottom of the storage chamber, said shelf being removable to provide access to the anchor bolts.

2. A parking lot fee collection box according to claim 1, wherein said money receiving receptacle means comprises at least one removable receptacle which sits on said shelf.

3. A parking lot fee collection box according to claim 2, wherein said door provides a front closure for the storage chamber and the collection box includes hinge means along the lower edge of the door, pivotally connecting it to a front portion of the collection box, generally at the level of said shelf.

4. A parking lot fee collection box, comprising:

wall means defining a money receiving and storage chamber, said wall means including a front door openable to provide access into said chamber, a top wall for the chamber including a plurality of money slots, and a bottom for said chamber, said money slots being of a size that paper money needs to be folded in order to be inserted through a slot;

removable money receiving receptacle means in said chamber below said top wall and insertable therein by way of said front door, including a support base which sits down onto the bottom of the chamber, and a plurality of individual compartments, each associated with a slot, each said compartment being vertically aligned with its slot, and each said compartment being vertically elongated;

wherein the upper ends of the compartments are spaced below the money slot carrying top wall at least about three-fourths of an inch, to provide a vertical space between each money slot and the top of the money receiving compartment associated with such slot; and a hood structure which extends over and provides a cover for the money slot carrying top wall.

5. A parking lot fee collection box according to claim 4, wherein said receptacle is constructed from a see-through material.

6. A parking fee collection box according to claim 4, wherein said money receiving receptacle means comprises a plurality of receptacle units, each of which is removable from said chamber.

7. A parking lot fee collection box according to claim 6, wherein each said receptacle is constructed from a see-through material.

8. A parking lot fee collection box according to claim 4, wherein said door constitutes a front closure for said storage chamber, and said wall means includes a pair of sidewalls, one on each side of said door, said door being hingedly connected to the collection box and including inwardly turning lip portions at its edges, and door reinforcing members carried by said sidewalls, said members being connected to inner portions of the sidewalls and with said sidewalls defining a slot in which the door lig portions are snugly received.

9. A parking lot fee collection box according to claim 4, wherein said hood includes a top portion that is spaced vertically above the money slot carrying top wall a distance small enough to prevent a person from sticking his head into a position over at least most of the money slots.

10. A parking lot fee collection box according to claim 9, wherein the hood structure projects horizontally forwardly of the front row of money slots.

11. A parking lot fee collection box according to claim 10, wherein the top of the hood slopes downwardly from the front of the box toward the back of the box.

* * * * *